United States Patent [19]

Miram et al.

[11] 4,096,406

[45] Jun. 20, 1978

[54] THERMIONIC ELECTRON SOURCE WITH BONDED CONTROL GRID

[75] Inventors: George Valentine Miram, Atherton; Erling Louis Lien, Los Altos, both of Calif.

[73] Assignee: Varian Associates, Inc., Palo Alto, Calif.

[21] Appl. No.: 684,689

[22] Filed: May 10, 1976

[51] Int. Cl.[2] ..... H01J 1/46; H01J 1/52; H01J 17/04; H01J 19/38

[52] U.S. Cl. ..... 313/348; 29/25.14; 29/25.17; 313/349; 313/447; 313/452

[58] Field of Search ..... 313/444, 447, 448, 452, 313/348, 349; 29/25.14, 25.17

[56] References Cited

U.S. PATENT DOCUMENTS

| | | | |
|---|---|---|---|
| 3,154,711 | 10/1964 | Beggs | 313/452 |
| 3,196,043 | 7/1965 | Harris et al. | 313/348 X |
| 3,278,779 | 10/1966 | Szegho | 313/447 |
| 3,297,902 | 1/1967 | Beggs | 313/348 |
| 3,638,062 | 1/1972 | Beggs | 313/348 |

FOREIGN PATENT DOCUMENTS

| | | | |
|---|---|---|---|
| 1,232,272 | 1/1967 | Germany | 313/348 |
| 275,238 | 7/1969 | U.S.S.R. | 313/348 |

*Primary Examiner*—Saxfield Chatmon, Jr.
*Attorney, Agent, or Firm*—Stanley Z. Cole; Robert K. Stoddard

[57] ABSTRACT

For a grid-controlled electron source to operate at extremely high frequencies, as in planar triodes, the control grid must be situated very close to the emissive cathode. Mechanical and thermal distortions have put minimum limits on grid spacings and hence on the maximum operating frequency of grid-controlled tubes. To overcome these limits the grid structure is formed as a network of web members which are part of a laminated sheet having metal layers bonded to opposite surfaces of an insulating layer. One metal layer is affixed to the emissive surface of a metallic matrix cathode and the other metal layer forms the control grid.

10 Claims, 6 Drawing Figures

FIG.1
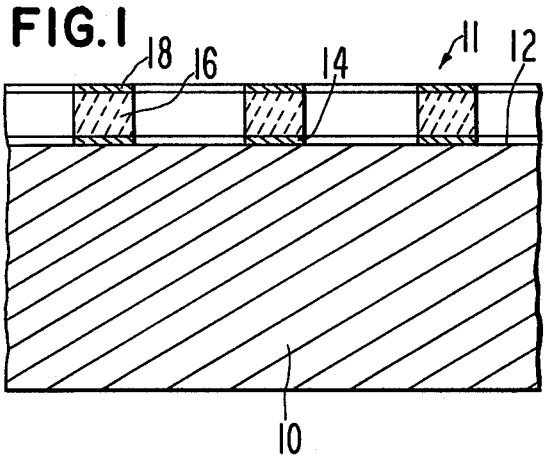
FIG.2a
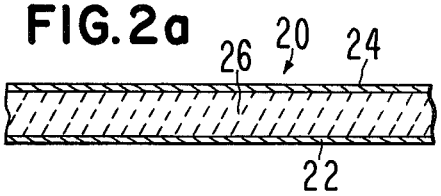
FIG.2b
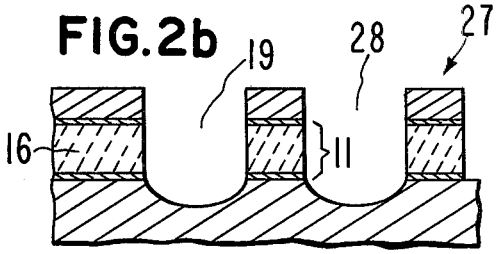
FIG.2c
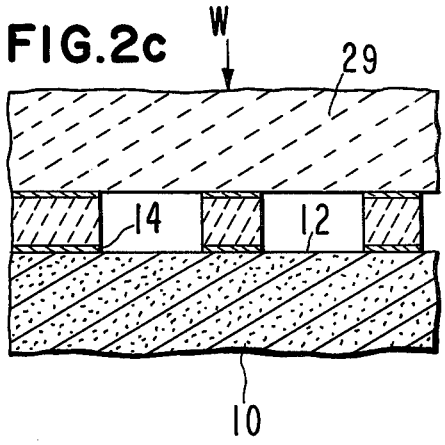
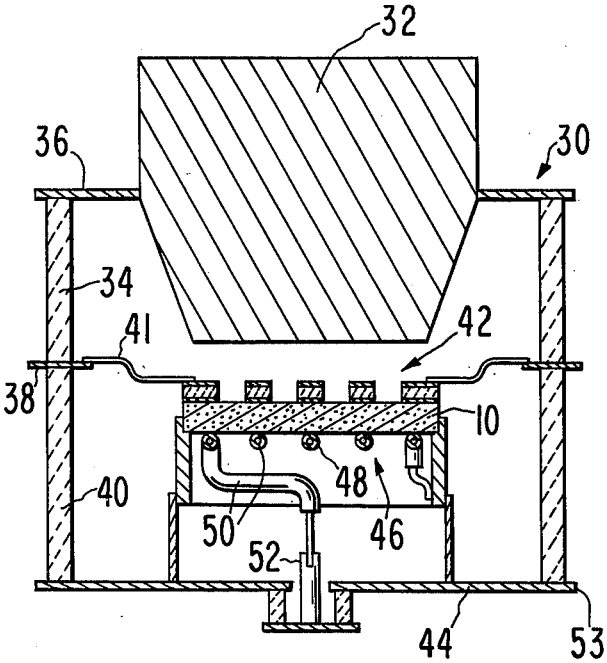
FIG.3
FIG.4
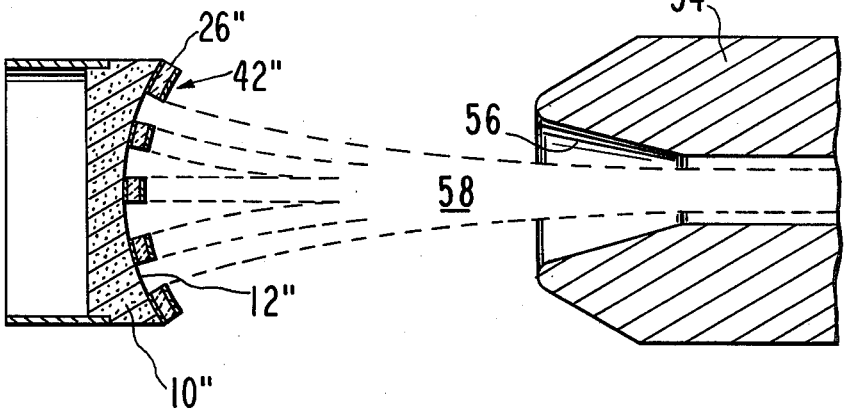

THERMIONIC ELECTRON SOURCE WITH BONDED CONTROL GRID

BACKGROUND OF THE INVENTION

GOVERNMENT CONTRACT

The invention was reduced to practice under U.S. Army Electronics Command Contract No. DAAB07-75-C-1321.

FIELD OF THE INVENTION

The invention pertains to grid-controlled electron sources, such as used in high frequency tubes such as planar triodes and in electron guns for beam-type microwave tubes. For a triode to operate at extremely high frequencies, it is necessary that the control grid be located very close to the cathode, so that the transit time of electrons between cathode and grid is minimized. In other grid-controlled sources, such as guns for linear-beam microwave tubes, as well as many grid-controlled power tubes, it is desirable to have the maximum transconductance and the maximum amplification factor. These can be simultaneously achieved only by a fine-mesh control grid located very close to the cathode.

DESCRIPTION OF THE PRIOR ART

The improvement of grid-controlled electron sources by conventional techniques of supporting the grid spaced from the cathode has reached its highest development in planar triodes where parallel grid wires are placed in tension across a frame which is then carefully spaced a few mils from the flat cathode surface. The limitations of this conventional structure posed by mechanical and thermal distortion of the parts and by vibration of the grid have led to attempts to mount the grid elements firmly on the cathode with intervening, insulating support members. In these previous attempts a network of insulating material was deposited on the cathode surface, as by chemical vapor deposition. Metal conductors were then deposited on the top surface of the insulator to form the control electrode. These previous attempts to fabricate bonded control grids were not successful because in the deposition processes the emissive cathode invariably became poisoned.

SUMMARY OF THE INVENTION

An object of the invention is to provide a grid-controlled electron source in which the control elements are mounted directly on the emissive cathode with insulative supports therebetween.

A further objective is to provide a control grid which is very close to the cathode and which has very small openings between control elements. A further object is to provide a process for fabricating a grid-controlled electron source by bonding the control elements directly to the cathode via insulating supports.

The above objects are achieved by fabricating the grid structure as a laminated sheet of insulating material with metal layers bonded to both opposite surfaces. The laminated sheet forms web members with openings therebetween. One of the metal layers is attached to the emissive cathode. The other, insulated metal layer forms the control electrode. In a preferred embodiment, the laminated sheet is formed as a continuous sheet and then portions are removed, as by abrasion, to form the openings between web members. The web structure is then attached to the emissive cathode surface. The lower metal layer may be bonded firmly to the cathode surface, as by thermal diffusion.

BRIEF DESCRIPTION OF THE DRAWINGS

FIG. 1 shows a section of an electron source according to the invention.

FIGS. 2A–2C illustrate the steps in fabricating the structure of FIG. 1.

FIG. 3 illustrates a planar triode embodiment of the invention.

FIG. 4 illustrates a convergent beam gun embodying the invention for use in a linear beam microwave tube.

DESCRIPTION OF THE PREFERRED EMBODIMENTS

FIG. 1 illustrates the structure of a small portion of an electron source according to the invention. A thermionic cathode 10, such as a porous tungsten matrix impregnated with molten barium aluminate is heated by a coil of tungsten heater wire insulated by a layer of aluminum oxide (as shown in FIG. 3). A top, emissive surface 12 of cathode 10 is shaped to face an anode (FIG. 3) for drawing electron current from the cathode. Grid web members 11 have an underlying barrier layer 14 which is attached directly to the emissive surface of the cathode, as by mechanical clamps or by thermal diffusion under pressure. Barrier layer 14 is of a material which will not poison cathode 10 and will prevent chemical interaction between cathode 10 and other materials of the grid web 11. In particular, it should prevent diffusion of barium from cathode 10 into the grid structure. Layer 14 may be a metal such as tungsten or a stable compound such as silicon nitride. It advantageously may be a metal which will bond to cathode 10 by thermal diffusion. Bonded to underlying layer 14 is a layer 16 of insulating material, as of boron nitride. On top of insulating layer 16 is bonded a metal layer 18 which is thus insulated from the cathode and serves as the control grid electrode. Web members 11 are preferably connected as a network having openings 19 between the web members 11, through which the electron current is drawn. Around the periphery of the web structure is a wider ring of the laminate whose metal layer 18 forms an electrically conductive connector. The bonded metal layers may advantageously be high temperature metals. They may be bonded to the insulator by evaporating or sputtering deposition thereon or by chemical vapor deposition. Their thickness may be increased by electro-plating. The control electrode 18 may be of thermionic-emission inhibiting material such as titanium or zirconium, or its exposed surface may be coated with such material to reduce grid emission. It has been found that barrier layer 14 may be 1–50 microns thick, insulating layer 16 may be 25 microns thick, and control electrode layer 18 may be 20 microns thick. Web members 11 have been fabricated 20 microns in width. Openings 19 between web members 11 are advantageously shaped as elongated rectangles to allow the greatest proportion of open area while still maintaining grid web members 11 in close proximity to all parts of the emissive area.

FIG. 2 illustrates the steps in fabricating the critical parts of the electron source of FIG. 1.

FIG. 2*a* shows a section of a laminated sheet 20 formed by depositing metal layers 22 and 24 on opposite sides of an insulating sheet 26 of boron nitride. In FIG. 2*b* a mask 27 having the configuration of the desired grid web structure is placed on the laminated sheet. Mask 27 is of sheet metal with apertures formed by conventional photo-etching techniques. Fine abrasive powders impelled by an air jet cut away the portions 19 of laminated sheet 20 beneath openings 28 in mask 27, leaving web members 11 in which the portions of opposing metal layers are separated by remaining portions 16 of insulating layer 26. Improved accuracy of abrasion has been obtained by cutting from both sides through aligned masks.

In FIG. 2*c* the web grid structure is placed upon emissive surface 12 of cathode 10. Compressive force, as by a weight 29 is applied uniformly over the surface. The assembly is heated, as to about 1100° C, at which temperature the lower, metal barrier layer 14 bonds by diffusion to emissive surface 12. Alternatively, the grid structure may be simply physically attached to cathode 10, as by spring clips.

FIG. 3 shows a planar triode tube embodying the electron source of the present invention. The tube comprises a vacuum envelope 30 formed partly by metallic anode 32 as of copper sealed to a cylindrical ceramic insulator 34, as of aluminum oxide ceramic, via a metal flange 36 as of iron-cobalt-nickel alloy. A conductive flange 38 as of the above alloy is sealed between ceramic cylinder 34 and a second ceramic cylinder insulator 40. Flange 38 is connected to grid electrode 42 by spring conductors 41 as of molybdenum or a tantalum-tungsten-columbium alloy which are sufficiently flexible to acommodate to the position of grid 42 which is fixed to cathode 10'. Cathode 10' is mechanically and electrically mounted to a metallic header 44 which is sealed across the bottom end of insulating cylinder 40, completing the vacuum envelope and permitting high-frequency electrical current contacts to all of the electrodes. Cathode 10' is heated by a radiant heater 46 formed by a coil of tungsten wire 48 insulated by a coating of aluminum oxide 50. An insulated lead-through 52, sealed as by brazing to metallic header 44, conducts heating current. In operation, resonant cavity radio-frequency circuits, such as coaxial resonators, are connected between cathode flange 53 and grid flange 38 and between grid flange 38 and anode flange 36. These resonators (not shown) contain series bypass capacitors to allow the application of a positive voltage to anode 32 and a bias dc voltage between cathode 10' and grid 42. RF drive energy is applied between cathode 10' and grid 42, modulating the electron flow from cathode 10' to anode 32. With the exceedingly small cathode-to-grid spacing achievable with the present invention, the transit time of electrons between cathode and grid is so small that exceedingly high frequency signals may be amplified. At the same time the rigid support of the grid electrode with respect to the cathode eliminates modulation by microphonic vibrations and prevents short-circuits by deformation of the grid structure.

FIG. 4 illustrates an electron gun according to the present invention adapted to produce a grid-controlled linear electron beam for use in a klystron or traveling wave tube. Cathode 10'' has a concave spherical emissive surface 12'' to converge the electrons into a beam considerably smaller than the area of cathode 10''. Grid 42'' is bonded or attached to cathode 10'' exactly as in the planar triode of FIG. 3. The boron nitride sheet 26'' is formed as a spherical cap, as by chemical-vapor-deposition and the grid 42'' is then fabricated as described above for a planar grid. Other parts of the gun are similar to those of the triode of FIG. 3 except that the anode 54 is a re-entrant electrode, symmetric about the axis of the beam, having a central apperture 56 through which the electron beam 58 passes to be used in the microwave tube.

Many other embodiments and uses of the invention will be apparent to those skilled in the art. The above examples are illustrative and not limiting. For example the electron source may be used in a multiple-grid tube such as a tetrode or pentode, and may be used in gas-discharge devices. The invention is intended to be limited only by the following claims and their legal equivalents.

We claim:

1. A method for fabricating a grid-controlled electron source comprising the steps of:

forming a continuous sheet laminate by bonding a barrier layer and a metallic layer to opposite sides of a sheet of insulating material, removing separated areas of said laminate to form an array of holes extending through the entire thickness of said laminate, said holes being separated by web members consisting of the original thickness of said web members, bonding the barrier layer side of said web members to the emissive surface of a thermionic cathode, and said removing step being performed prior to said bonding of said laiminate to said emissive surface.

2. The method of claim 1 further comprising the step of making electrical contact, insulated from said cathode, to said metallic layer.

3. The method of claim 1 wherein said removing of said portions is by abrasion.

4. The method of claim 1 wherein the portion of said cathode adjacent said emissive surface is a porous metal body impregnated with an active salt composition.

5. The method of claim 4 wherein said porous metal body comprises sintered tungsten particles.

6. The method of claim 4 wherein said salt composition comprises barium and aluminum oxides.

7. The method of claim 1 wherein said insulating layer is boron nitride.

8. The method of claim 1 wherein said barrier layer is metallic.

9. The method of claim 1 wherein said metallic layer comprises at least one metal of the class consisting of zirconium and titanium.

10. The method of claim 1 wherein said step of attaching said barrier layer to said emissive surface comprises thermal bonding.

* * * * *